United States Patent [19]

Roose

[11] Patent Number: 4,655,117

[45] Date of Patent: Apr. 7, 1987

[54] COMPLETE TRANSPOSABLE NOTATION AND KEYBOARD MUSIC SYSTEM FOR TYPISTS

[76] Inventor: Lars D. Roose, 10100 Chapala Ct., NE., Albuquerque, N. Mex. 87111

[21] Appl. No.: 746,271

[22] Filed: Jun. 19, 1985

Related U.S. Application Data

[63] Continuation-in-part of Ser. No. 617,229, Jun. 4, 1984, abandoned.

[51] Int. Cl.[4] ..... G10C 3/12

[52] U.S. Cl. ..... 84/423 B; 84/483 A

[58] Field of Search ..... 84/423, 404, 483

[56] References Cited

U.S. PATENT DOCUMENTS

| | | | |
|---|---|---|---|
| 2,159,491 | 5/1939 | Rose | 84/423 B |
| 2,561,615 | 7/1951 | Edwards | 84/423 X |
| 2,780,127 | 2/1957 | Hennick | 84/107 |
| 3,055,252 | 9/1962 | Marsich | 84/404 |
| 4,031,800 | 6/1977 | Thompson | 84/423 |

FOREIGN PATENT DOCUMENTS

| | | | |
|---|---|---|---|
| 2005955 | 2/1970 | Fed. Rep. of Germany | 214/84 |
| 158857 | 2/1933 | Switzerland | 84/483 |
| 1428551 | 3/1976 | United Kingdom | 84/423 B |

*Primary Examiner*—Lawrence R. Franklin
*Attorney, Agent, or Firm*—Samuel M. Freund

[57] ABSTRACT

A typewriter keyboard instrument wherein the keyboard is arranged as a standard typewriter with only letters, numbers, and symbols of the standard keyboard wherein the key with the letter N is assigned to play the note middle C, and wherein each succeeding key to the right plays a note which is a half-step higher than the note played by the preceeding key, and two expanded keyboards; the first expanded keyboard having five additional keys on each end of each row, wherein each additional key plays a note one half-step lower or higher than the adjacent key; and the second expanded keyboard having five additional keys on the right hand end of each row of keys and seven additional keys on the left end of each additional row wherein each additional key plays a note which is one half-step higher or lower than the adjacent keys, and wherein the music for the standard and the expanded keyboards is written with a key designation in the clef and wherein the dark notes have a light letter corresponding to the key to be pressed and the light notes have a dark or black letter in the center thereof to designate the key to be pressed, and wherein an ordinary typist with only a basic knowledge of music can sit down to the instrument, readily read the music, automatically correlate the music to the keyboard, play the instrument and, at will, transpose to any new key to play the music in, simply by moving the placement of his/her home row fingers location to the left or right of the original home row on the expanded keyboards.

2 Claims, 9 Drawing Figures

COMPLETE TRANSPOSABLE NOTATION AND KEYBOARD MUSIC SYSTEM FOR TYPISTS

This invention is a continuation-in-part of patent application Ser. No. 617,229, filed on June 4, 1984 by Lars D. Roose entitled "A Matrix Typewriter Keyboard Musical Instrument," now abandoned.

BACKGROUND

1. Field of the Invention

This invention relates primarily to a method of writing music for typewriter keyboards, and an instrument for playing said written music with an emphasis on the ease with which a typist can transpose to new keys in music.

2. Description of the Prior Art

Keyboard instruments are old in the history of the human race. The most well known at the present time are probably the piano, the organ, and the accordian. Recently, however, there have been developments in the field of communications, computers, and printing. As a result, there are a great many people who are completely familiar with, even expert at, the standard types of keyboards for the typewriter and computers, and who cannot play ordinary music as it is written, nor as it is played on conventional musical instruments, not to mention transposing keys.

The number of musical instruments which have tried to use typewriter keyboards has grown, but their utility has been limited by the fact that the typist must still learn to read the standard musical scores. ORMAN, an English Pat. No. 1428551, dated March, 1976 taught a musical instrument and method of writing the music in letters so that the typist could play the music. The invention of ORMAN, however, assumed that "the typist will know the tune sufficiently to hold some notes longer than others." (ORMAN at page 3 lines 70–73). WELSCH, a West German Pat. No. 2005955, dated August, 1971, also taught a musical instrument and method of writing the music in letters so that the typist could play the music. The invention of WELSCH, however was at best only slightly better than the ORMAN invention, since it either assumed the typist was familiar with the tune or was limited to tunes made up of only quarter-notes and half-notes by the placement of a horizontal line directly beneath the letter for indicating a quarter-note, and the placement of a horizontal line directly above the letter to indicate a half-note. (WELSCH in FIG. 2).

THOMPSON, U.S. Pat. No. 4,031,800, issued June 28, 1977, taught a two dimensional keyboard whose keys were arranged in perpendicular rows. THOMPSON designed his keyboard so that all standard music literature could be played on his keyboard. While THOMPSON designed his keyboard instrument primarily for one skilled at playing the THOMPSON keyboard and also skilled in reading music and in correlating the music to the keyboard; the only similarity between the THOMPSON keyboard and the present invention is that, on both instruments, a musical score can be played in any key, yet the fingering motions remain the same if the musical score were to be played in a different key. A typist would stil have to learn the THOMPSON keyboard, music notation, and correlation between the two to become proficient at making music on his keyboard. Additionally, the THOMPSON keyboard, even if geometrically and identifiably converted to a typewriter keyboard layout would become a confusing system of notes. At the same time the THOMPSON keyboard would have approximately half the range of notes as the present invention.

SUMMARY

This invention comprises a method of writing music so that a typist can immediately read the music, and on a typewriter keyboard instrument play the music. Together, the method of writing music and the new typewriter instrument comprise a musical instrument system which immediately enables a typist with only a limited knowledge of conventional music notation to pick up a sheet of music and play the score, even if the score was totally foreign to the typist. It will be noticed that an ordinary typewriter and most computer and word processor keyboards are not arranged in a perfectly vertical matrix, as is THOMPSON's. Instead because of the normal digital dexterity, from the bottom row to the next higher row on a standard typewriter keyboard, the keys in the next higher row are displaced one-half key to the left. But from the next to the bottom row of keys, commonly called the home row, to the row above the home row, the keys in the higher row are displaced only about a quarter of a key to the left. And finally the keys in the top row, commonly called the number row, are displaced a half key to the left of the corresponding key in the row just below the number row. This key arrangement is important because of the normal fingering dexterity, and more importantly, because this is precisely the keyboard that typists in general know automatically. The music which comprises a major portion of the system is written basically so that the frequency, or pitch determining part of the note, hereinafter referred to as the ball of the note, contains the letter, number or other symbol corresponding to the respective key on a standard keyboard which when pressed, sounds that particular note. Thus, the quater-note will have a normal dark ball and staff, and the dark ball will have a white or contrasting letter or other designation within the dark ball, and the half note would have its usual staff and light ball and the light ball would have a black or dark letter or other designation within. Thus it is the main objective of this invention to provide an instrument and a method of musical notation which will enable an ordinary typist, with only a limited knowledge of the conventional musical notation, to immediately take a sheet of music, and sit to the keyboard and immediately begin playing accurately, even though he/she had never seen, nor was familiar with, the score.

DESCRIPTION OF THE PREFERRED EMBODIMENT

Figure 1:
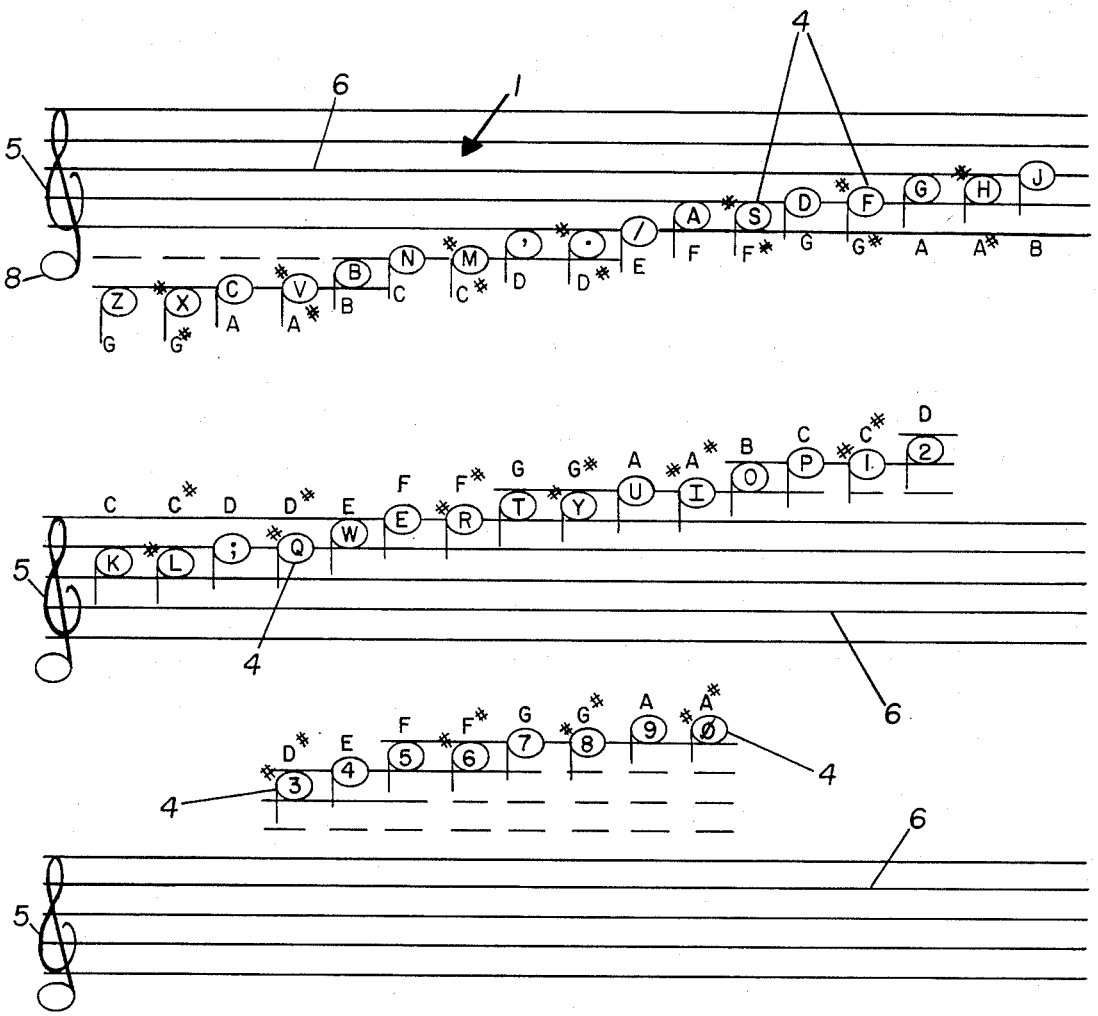
FIG. 1 depicts a musical scale with notes.
Figure 2:
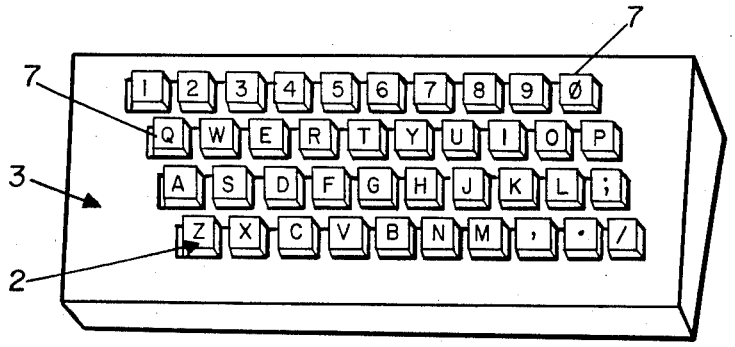
FIG. 2 is an isometric of the basic standard musical typewriter keyboard.
Figure 5:
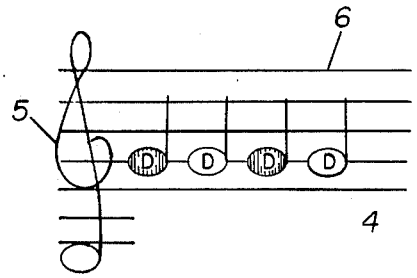
FIG. 5 depicts a musical measure with the treble clef with the middle, treble, note G.
Figure 6:
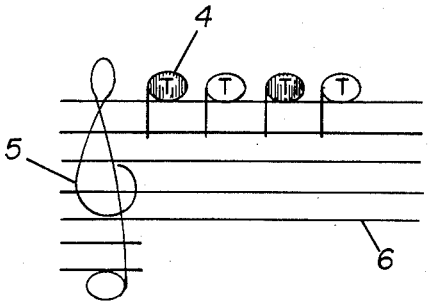
FIG. 6 depicts a musical measure with the treble clef with the note G one octave higher than in FIG. 5.
Figure 7:
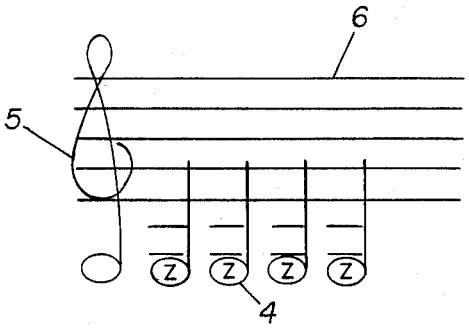
FIG. 7 depicts a musical measure with the treble clef with the note G one octave lower than FIG. 5.
Figure 8:
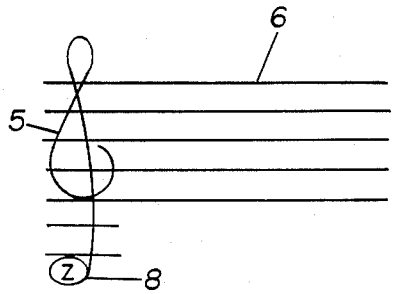
FIG. 8 depicts a musical measure showing the treble clef having the normal key designation within the clef.
Figure 9:
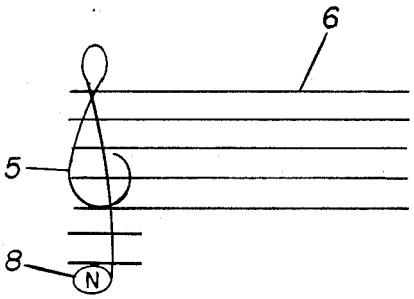
FIG. 9 depicts a musical measure showing the treble clef having a transported key designation.

The invention is shown in FIGS. 1 and 2 to comprise music 1 written for a typewriter keyboard 2 which is included into a means for producing musical tones, such as a synthesizer type musical instrument 3. FIG. 2 shows the standard keyboard 2 to be a typewriter keyboard and to have forty keys 7 arranged into four rows of ten keys 7 each, wherein each key 7 when pressed plays a single note. As shown in FIG. 1, the music is comprised of notes 4 shown on a standard musical sheet, having a clef 5 with a ball 8, and five horizontal lines 6. There could also be considerable additional information such as measures, beats per measure, articulation, but for the sake of simplicity these and other information are excluded from the drawings. FIG. 8 shows the letter Z in the bottom of the clef 5. This indicates to a typist that the home row, the row where he/she is to initially place his/her fingers, is the set of keys 7 where the left little finger would normally be used to type the letter Z using conventional touch typing techniques. In the illustration as shown in FIG. 8 the typist would position his/her left hand over the keys 7 lettered A,S,D,F and the typist places the fingers of the right hand over the keys 7 lettered J,K,L, and ";". In the traditional treble clef 5 notation in music, the note G is designated by a large fancy letter G which crosses through and curls around the vertical position of the note G within the five traditional horizontal lines 6 contained in the usual musical notation system as shown in FIG. 5. This fancy G designation of the treble clef 5 can also be thought of to loop around the note G as shown in FIG. 6, one octave above the note G of FIG. 5. This fancy treble clef 5 can also be thought to encircle or otherwise similarly indicate the note G one octave below the note G of FIG. 5 as shown in FIG. 7. With the present invention, it is the note G as shown in FIG. 7 which serves to designate in which key a musical piece or portion of a musical piece is to be played. The way this is accomplished is by showing the lowest note attainable on the keyboard 2 of the present invention using standard fingering techniques by the little finger of the left hand inside the ball 8 of the treble clef 5 as shown in FIG. 8. In the normal home row of keys 7 using standard touch typing techniques, the little finger of the left hand is appropriate for typing the letters Z,A,Q, and one. Since the key 7 with the Z letter is the key 7 which would play the lowest pitched note 4 on the keyboard 2 of the present invention when the fingers of the typist were originally placed over the traditional home row, the note G as shown in FIG. 7 would be the key 7 designation for using the normal home row by having the letter Z inserted in the ball 8 of the clef 5 as shown in FIG. 8. Thus the note G as shown in FIG. 7 is assigned to the key 7 with the letter symbol Z as shown in FIG. 1, and the whole keyboard 2 is laid out with respect to the key 7 with the letter Z being the note G which with the preferred embodiment dictates that the note middle C must be assigned to the key 7 with the letter N, also as shown in FIG. 1, since as will be explained hereinafter each successive key 7 on the keyboard 2 plays a note which is one half note higher than the note played by the immediately preceeding key 7 in that row.

If the music is to be played in some other key than the original key, the designation as shown in FIG. 8 in the ball 8 of the clef would change. If, for example, the music was originally played in the key of G minor and this was indicated by a Z appearing in the ball 8, and it was then desired that the music was to be played in the key of C minor, then the designation in the ball 8 of the clef 5 would be the letter N and the home row of keys 7 for the typist would be shifted to the right so that the lowest pitch attainable using standard fingering techniques from the new home row would be the note middle C which is played by pressing the key 7 with the letter N with the little finger of the left hand. Therefore any musical score may be transposed to any musical key using the same fingering motions as with the original musical key, simply by shifting the location of the home row, while at the same time keeping the same notation with which the typist is familiar.

Referring now to FIG. 1, it is seen that in those notes 4 which have light or white centers, a dark letter is inserted inside the white or light center of the note 4. The stems, or absence thereof, which indicate the length of time which the note is to be played are retained. Thus, the typist needs only to read the letter within the note to determine which fingering motion to exercise, and the length of time to hold or press the key 7 is determined by the stems and flags. In notes, such as quarter and eighth notes, where the center of the note is usually darkened or black, a white or light letter is inserted which corresponds to the fingering motion to be exercised, and the length of time to hold the key 7 is determined by the stems and flags. In addition, the quick identification of letters within the centers of the notes is enhanced by the vertical positioning of the notes in the lines 6. As far as a typist is concerned, the music is complete with only a clef 5 and the notes, and the lines are not needed; yet the vertical arrangement of the notes according to the pitch of the note is a definite visual aid. The standard keyboard 2 has four rows of ten keys 7 each, with letters, numbers and characters on them as shown in FIG. 2. The row which is closest to the typist is called the bottom row; the row which is next above the bottom row is herein referred to as the home row, the second row, or the next to the bottom row. The row above the home row is herein called the third row; and the fourth row is herein called the number row or the top row. In order to minimize any learning process for the typist, the key 7 designation would remain unchanged. Thus the bottom row would have the letters and characters from left to right in sequence as Z,X,C,V,B,N,M,comma,period, and slant bar; and the home row would have the letters and characters A,S,D,F,G,H,J,K,L, and the semicolon. The row above the home row would have the letters Q,W,E,R,-T,Y,U,I,O,P and the number row would have the numbers 1,2,3,4,5,6,7,8,9, and zero. It now can be seen that in the foregoing example of playing in a different key how the typist would read and play when intentionally shifting hands in the beginning to a new home row.

The keyboard 2 is shown in FIG. 2 as being a standard musical typewriter keyboard 2. As shown, it is important to note that the keys 7 are not evenly spaced or shifted from one row to another row. From the home row, A,S,D,F, the keys 7 in the row below are shifted approximately one half key-width to the right. That is, the first key 7 in the lower row, Z, is evenly aligned in the lower-most row half way between the key 7 with the letter A and the key 7 with the letter S. However, the first key 7 in the row above the home row with the letter Q is spaced only about a quarter of a key-width to the left of the key 7 with the letter A. Additionally, the first key 7 with the number one in the upper-most row is again spaced approximately one-half a key-width to the left of the key 7 with the letter Q. This arrangement is important to retain because it is the arrangement with which the typist is extremely familiar and more proficient. This arrangement is also designed for the natural dexterity of the fingers.

With the above described arrangement, the keyboard 2 would have four rows of ten keys 7 each, for a total of forty keys 7 and forty notes that would each be played. In addition, there would be very little space for choosing a new home row., and thus little ability to change the key in which the score to be played could be performed. To overcome these limitations, and to expand the versatility of the instrument, additional keys 7 are added to the left and right hand end of each row on the standard keyboard 2 to form an expanded keyboard 9. Two configurations of expanded keyboards 9 have been found to be very functional. The first configuration, shown in FIG. 3, has five additional keys 7 on the left hand end of each row and five additional keys 7 on the right hand end of each row. The second configuration of an expanded keyboard 2 is shown in FIG. 4 has seven additional keys 7 on the left hand end of each row, and five additional keys 7 on the right hand end of each row. This second configuration provides the extra range at the lower end of the musical spectrum so that twelve possible keys of music can be played by designating the desired key with which to select the appropriate home row starting position for the typist.

To correlate the written music with the keyboard 2, the key 7 on the standard keyboard 2 of FIG. 2 with the letter N is assigned the note middle C as explained above. Each key 7 on the standard keyboard 2 to the right of the key 7 with the letter N is one-half step higher than the note played by pressing the preceding key 7 in that row, and each key 7 to the left of the key 7 with the letter N is assigned a note which is a half-step lower than the note played when the preceding key 7 in that row is pressed. That is, the key 7 with the letter M when pressed, plays a note which is a half-step higher than the note played when the key 7 with the letter N is played; and similarly the note played when the key 7 with the letter B is pressed is a half-step lower than the note played when the key 7 with the letter N is pressed. The note plated when the key 7 with the letter C is pressed would be two half-steps lower, or a whole step lower, than the note played when the key 7 with the letter B is pressed. The highest note played by pressing keys 7 on the bottom row would be played when the key 7 with the slant bar is pressed. The key 7 with the letter A being designated the first key 7 of the next higher row of keys 7 when pressed would play a note one-half step higher than the note played when the key 7 with a slant bar was played, and each succeeding key 7 in the second, or home, row would play a note one-half step higher than the note played by pressing the preceding key 7. Pressing the key 7 with a semicolon would play the highest note of all the keys 7 in the second row. The key 7 with the letter Q, being the first key 7 in the third row would play, when pressed, a note which is one-half step higher than the note played when the key 7 with the semicolon is pressed. Likewise, each successive key 7 in the third row would play a note when pressed, one-half note higher than the note played when the preceding key 7 is pressed. Thus when the key 7 with the letter P is pressed, it will play a note higher than the notes played by pressing any other key 7 on the third row. Finally, the first key 7 in the number row, with the number one, is to play, when pressed, a note which is one half-step higher than the note played when the key 7 with the letter P is pressed; and each successive number key 7 will, when pressed, play a note which is one half-step higher than the note played by pressing the preceding key 7. The key 7 with the number zero, when pressed, will play the highest note played by pressing any key 7 on the number row, or by pressing any key 7 on the entire standard keyboard 2.

It can now be seen that all the keys 7 on the standard keyboard 2, and all the keys 7 on either of the expanded keyboards 2 further discussed below have only a letter, symbol, or number on each key 7. Since there is no musical correlation between the letters, numbers, or symbols and musical notes as usually written, it is necessary that the instrument be accompanied by the music. Without the music, written as herein described, the typist would be unable to play. Indeed, the ordinary typist could not sit to the instrument and play music as it is ordinarily written.

Figure 3:
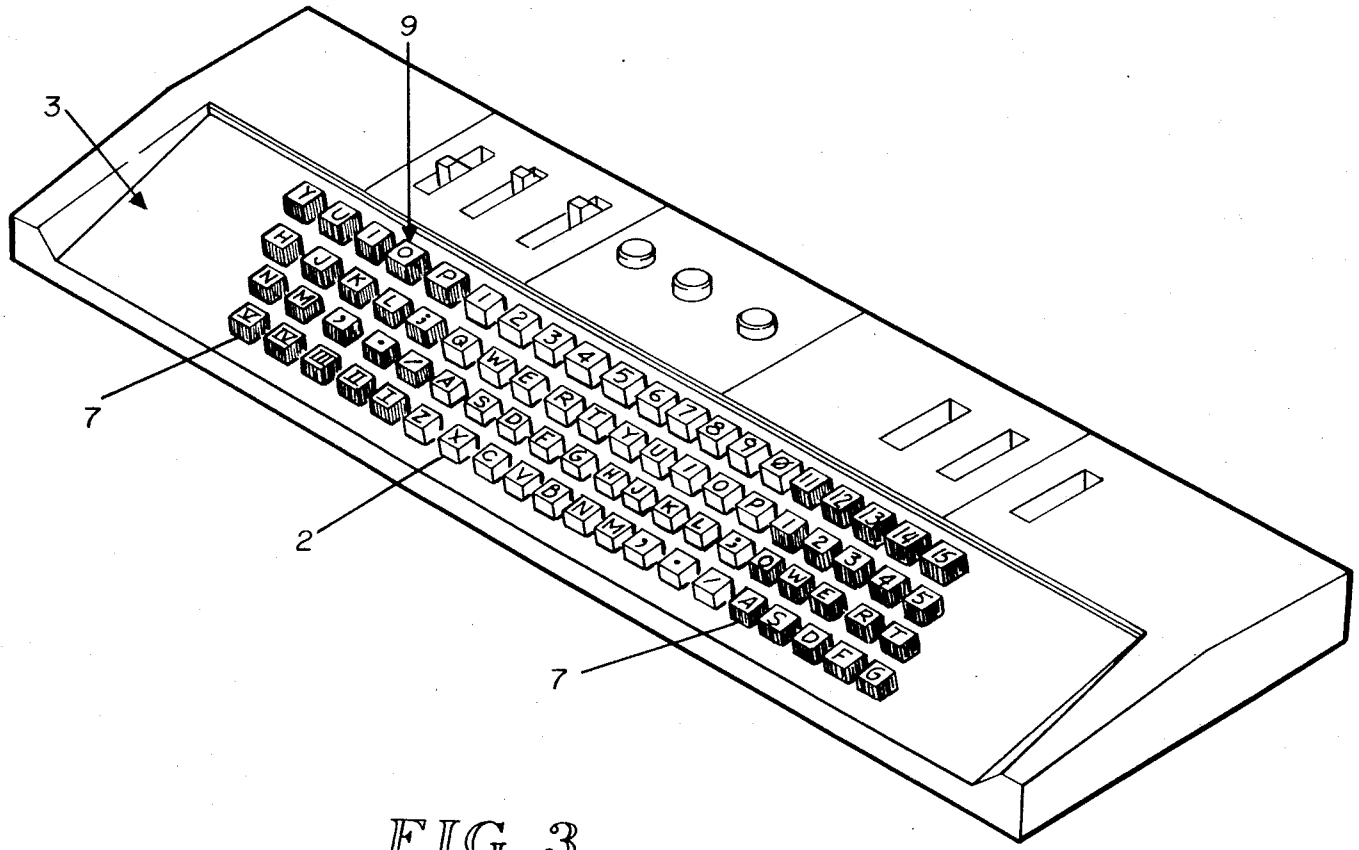
FIG. 3 is an isometric of an expanded musical typewriter keyboard wherein five keys are added to each end of each row of a basic keyboard.
Figure 4:
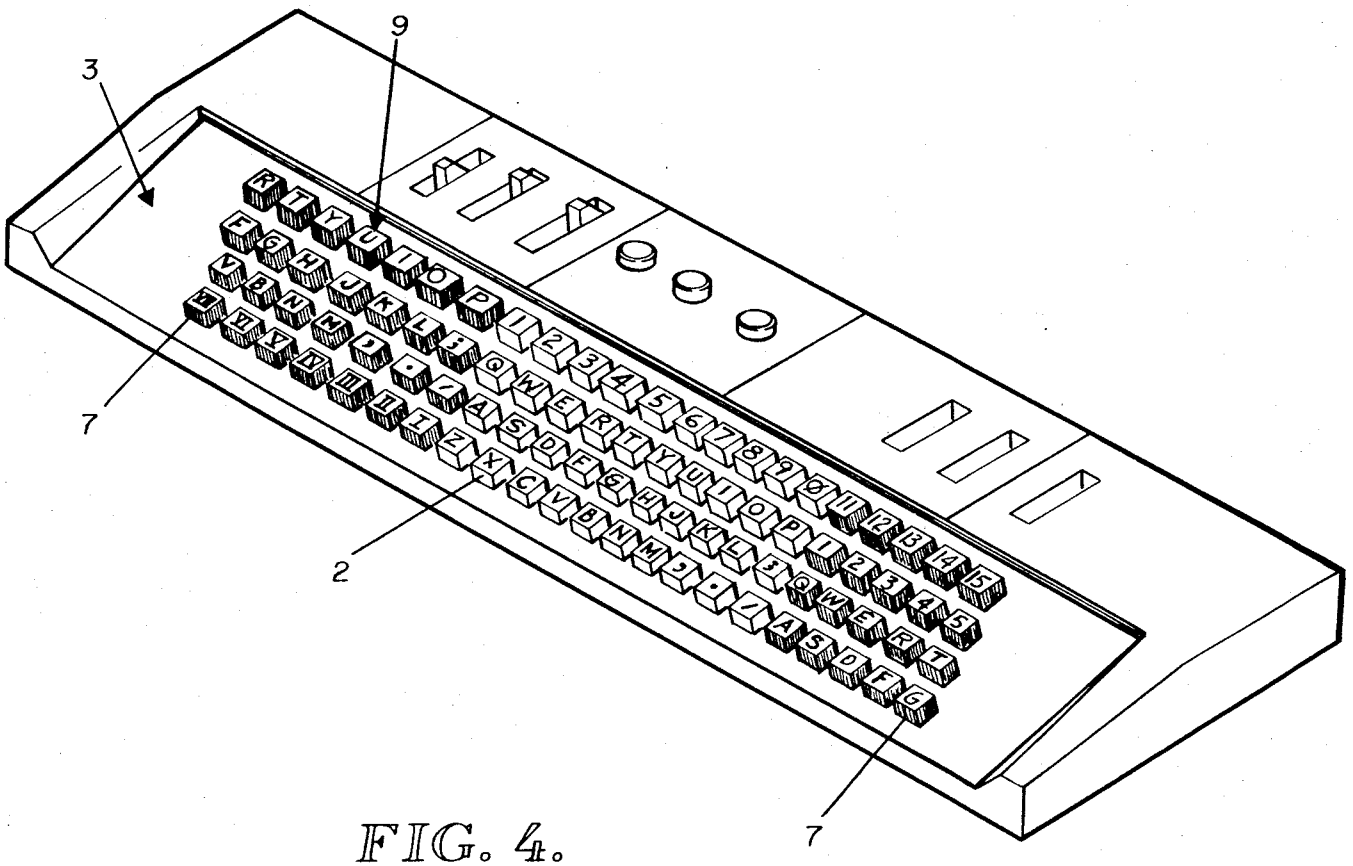
FIG. 4 is an isometric of an expanded musical typewriter keyboard wherein seven keys are added to the left end of each row of a basic keyboard.

On the first configuration of expanded keyboards 2 shown in FIG. 3, the keys 7, to the left of the key 7 with the letter Z, play, when pressed successively from right to left, notes which are a half-step lower than the note played when the adjacent key 7 towards the key 7 with the letter Z is pressed and the keys 7 to the right of the key 7 with the slant bar in the lower row, each, when pressed, play a note which is a half-step higher than the note played by pressing the preceding adjacent key 7 to the left. Thus the additional keys 7, to the right of the key with the slant bar in the lower row, when pressed play the same notes as would be played by pressing the keys with the letters A,S,D,F,G. In a similar fashion, the keys 7 to the right of the key 7 with the semicolon, when pressed, would duplicate the notes played by pressing the keys 7 with the letters Q,W,E,R,T. The additional notes played when the keys 7 to the right of the key 7 with a zero in the number row, are higher than any notes played when any of the keys 7 in the standard keyboard 2 are pressed. The additional keys 7 to the left of the key 7 with the letter Z, when pressed, would play notes that are lower than any notes played by pressing any of the keys 7 on the standard keyboard 2. The keys 7 to the left of the key 7 with the letter Z bear designations with the Roman Numerals I,II,III,IV, and V respectively right to left; while the additional keys 7 to the right of the key 7 having the number zero bear designations 11,12,13,14, and 15 sequentially in order to write music for them. The added keys 7 to the left hand end of the three higher rows bear the same designations as the keys 7 in the standard keyboard 2 which play, when pressed, the same notes. Thus the key 7 immediately to the right of the key 7 with a slant bar in the bottom row, would also have the letter A, and when pressed will play the same note as when the key 7 in the second row with the letter A plays when pressed.

In the second configuration of expanded keyboards 2 shown in FIG. 4, the seven keys 7 to the left of the key 7 with the letter Z in the bottom row, again successively play when pressed, notes which are one half-step lower than the note played when the preceding key 7 is pressed, and bear the designations from right to left as I,II,III,IV,V,VI, and VII. The seven keys 7 to the left of each key in each row higher than the bottom row likewise when pressed plays a note which is a half-step lower than the note played by pressing the preceding key 7 in that row, and bear the designation of the key 7 in the standard keyboard 2 which when pressed plays the same note. For example, the seven keys 7 to the left of the key 7 with the letter A in the home row, from right to left, would bear the designations slant bar, period, comma,M,N,B, and V; and the keys 7 to the left of the key 7 bearing the number one in the top row from right to left, would bear the designations P,O,I,U,Y,T, and R. So that the typist can identify with less effort which keys 7 are the standard keyboard 2 keys 7, all additional keys 7 in either of the expanded keyboards 2 may be of a different color or shade of color.

When transposing musical keys in which a score is to be played, the music would be written exactly the same so that the typist would use the same fingering motion striking the keys 7 as indicated on the music, but in fact because of the different location on the home row, the typist would be actually hitting keys 7 not indicated on the written music. It is now apparent that the relative spacing of the rows of keys 7 with respect to each other must be maintained so that when the typist changes his/her fingering location on the home row intentionally as indicated by the sheet music, he/she still fingers the keyboard in his/her usual automatic manner. This is necessary so that the typist does not have to learn to type on a different keyboard, but can use his/her already learned typist skills to immediately sit down and play music, with only a very basic knowledge of traditional written music.

It should be pointed out that while the standard keyboard 2 as designed by Christopher Latham Scholes in the 1870's has been used as a basis for this description, if any other keyboard 2 scheme which has the letters, symbols and numbers in different places becomes popular in use, the keys 7 would merely have to be redesignated while playing the same notes. The inventor is mindful of the Dvorak keyboard, not shown, designed by August Dvorak about 1930 and its expanded use in several state governments and by directory assistance operators. The four tows of ten keys 7 each in the Dvorak keyboard 2 would form the standard keyboard 2 for the instrument of the present invention, and the additional keys 7 in the expanded keyboards 2 would when pressed play the additional notes or redundant notes in a similar fashion. Thus the term, standard keyboard, is here defined to be either the one with a home row beginning with the letters A,S,D,F,G or the Dvorak keyboard with the home row beginning with the letters A,O,E,U,I.

I claim:

1. A keyboard for a musical instrument of a type which includes means for producing musical tones when the keys are touched, wherein each key of the keyboard when pressed plays a particular note, said keyboard comprising a standard typewriter keyboard wherein each key has a letter, symbol, or number, and wherein the keys of the standard keyboard are arranged in four horizontal rows of ten keys in each row, and wherein the bottom row is closest to a person playing the instrument, and wherein the row next to the bottom row has its keys offset approximately one-half key-width to the left with respect to the bottom row, and wherein the third row of keys is offset approximately one-quarter key-width from the next to the bottom row of keys to the left, and wherein the fourth and top row of keys is offset to the left with respect to the third row of keys approximately one-half key-width, and wherein the sixth key from the left in the bottom row when pressed plays the note middle C, and wherein the notes played when keys in any row are pressed sequentially from left to right are successively one half-step higher than the note played when the preceding key is pressed, and wherein the first key in all rows, but the bottom row, when pressed play a note one half-step higher than the note played when the key at the right hand end of the next lower row is pressed, and wherein five additional keys are added to the right hand end of each row, and seven additional keys are added to the left hand end of each row, and wherein the additional keys at the right hand end of each row when pressed sequentially from left to right play a note which is one half-step higher than the note played by pressing the key immediately adjacent to the left, and wherein the additional keys at the left end of each row when pressed sequentially from right to left play a note one half-step lower than the note played when the key immediately adjacent to the right is pressed, and wherein, therefore the additional keys on the left end of the bottom row play lower notes than any keys on the standard keyboard, and wherein, therefore, the additional keys to the right of the top row play notes which are higher than any notes played by pressing any keys of the standard keyboard, and wherein the additional keys, when pressed, on the left end of the second, third and top rows play redundant notes and these additional keys are designated with the same letter or symbol as the key in the standard keyboard which plays the same note, and wherein the additional keys on the right hand end of the bottom, second and third rows also play redundant notes when pressed, and these additional keys are designated with the letter, symbol, or number of the key in the standard keyboard which when pressed play the same note, and wherein the additional keys to the right of the top row are from left to right designated 11, 12, 13, 14, and 15, and the additional keys to the left of the bottom row are designated respectively from right to left as I, II, III, IV, V, VI, and VIII, and wherein the music written for the said instrument comprises a standard musical score with a key designation in a ball in a clef, and said key designation being indicated by a letter in the ball, and wherein the letter in the ball designates the specific key which a typist would normally finger using his/her left hand little finger to strike the closest and furthest left key using normal touch typing techniques thereby designating a home row to the typist, and wherein the notes which are normally light in the center would have dark letters, numbers, or symbols which indicate which key the typist should press, and those notes which are normally dark in the center would have light letters in the center, wherein a typist could sit to the instrument, read the letters, numbers, and symbols on the sheet of music and using his/her normal typing expertise immediately begin playing the musical score.

2. A keyboard for a musical instrument of a type which includes means for producing musical tones when the keys are touched, wherein each key of the keyboard when pressed plays a particular note, said keyboard comprising a standard typewriter keyboard wherein each key has a letter, symbol, or number, and wherein the keys of the standard keyboard are arranged in four horizontal rows of ten keys in each row, and wherein the bottom row is closest to a person playing the instrument, and wherein the row next to the bottom row has its keys offset approximately one-half key-width to the left with respect to the bottom row, and wherein the third row of keys is offset approximately one-quarter key-width from the next to the bottom row of keys to the left, and wherein the fourth and top row of keys is offset to the left with respect to the third row of keys approximately one-half key-width, and wherein the sixth key from the left in the bottom row when pressed plays the note middle C, and wherein the notes played when keys in any row are pressed sequentially from left to right are successively one half-step higher than the note played when the preceding key is pressed, and wherein the first key on the left end in all rows, but the bottom row, when pressed play a note one half-step higher than the note played when the key at the right hand end of the next lower row is pressed, and wherein five additional keys are added to each end of each row of the standard keyboard, and wherein the additional keys at the right hand end of each row when pressed sequentially from left to right play a note which is one half-step higher than the note played by pressing the key immediately adjacent to the left, and wherein the additional keys at the left end of each row when pressed sequentially from right to left play a note one half-step lower than the note played when the key immediately adjacent to the right is pressed, and wherein, therefore the additional keys on the left end of the bottom row play lower notes than any keys on the standard keyboard, and wherein, therefore, the additional keys to the right of the top row play notes which are higher than any notes played by pressing any keys of the standard keyboard, and wherein the additional keys, when pressed, on the left end of the second, third, and top rows play redundant notes and these additional keys are designated with the same letter or symbol as the key in the standard keyboard which plays the same note, and wherein the additional keys on the right hand end of the bottom, second and third rows also play redundant notes when pressed, and these additional keys are designated with the letter, symbol, or number of the key in the standard keyboard which when pressed will play the same note, and wherein the additional keys to the right of the top row are from left to right designated 11, 12, 13, 14, 15, and the additional keys to the left of the bottom row are designated respectively from right to left as I, II, III, IV, and V, and wherein the music written for the said instrument comprises a standard musical score with key designation in a ball in a clef, and said key designation being indicated by a letter in the ball, and wherein the letter in the ball designates the specific key which a typist would normally finger using his/her left hand little finger to strike the closest and furthest left key using normal touch typing techniques thereby designating a home row to the typist, and wherein the notes which are normally light in the center would have dark letters, numbers, or symbols which indicate which key the typist should press, and those notes which are normally dark in the center would have light letters in the center, wherein a typist could sit to the instrument, read the letters, numbers, and symbols on the sheet of music and using his/her normal typing expertise immediately begin playing the musical score.

* * * * *